United States Patent [19]

Payne

[11] 4,405,433

[45] Sep. 20, 1983

[54] ALUMINUM REDUCTION CELL ELECTRODE

[75] Inventor: John R. Payne, Pleasanton, Calif.

[73] Assignee: Kaiser Aluminum & Chemical Corporation, Oakland, Calif.

[21] Appl. No.: 251,652

[22] Filed: Apr. 6, 1981

[51] Int. Cl.[3] ..... C25C 3/08; C25C 3/16

[52] U.S. Cl. ..... 204/225; 204/243 R; 204/297 R

[58] Field of Search ..... 204/67, 243 R–247, 204/225, 297 R

[56] References Cited

U.S. PATENT DOCUMENTS

| | | | |
|---|---|---|---|
| 2,423,714 | 7/1947 | Leonard | 204/243 R X |
| 3,028,324 | 4/1962 | Ransley | 204/243 R X |
| 3,067,124 | 12/1962 | De Pava | 204/67 X |
| 3,909,375 | 9/1975 | Holliday et al. | 204/243 R X |
| 3,960,678 | 6/1976 | Alder | 204/67 |

FOREIGN PATENT DOCUMENTS

| | | | |
|---|---|---|---|
| 2051864 | 1/1981 | United Kingdom | 204/67 |

*Primary Examiner*—Donald R. Valentine

*Attorney, Agent, or Firm*—Paul E. Calrow; Edward J. Lynch

[57] ABSTRACT

The invention is directed to an anode-cathode structure for an electrolytic cell for the reduction of alumina wherein the structure is comprised of a carbon anode assembly which straddles a wedge-shaped refractory hard metal cathode assembly having steeply sloped cathodic surfaces, each cathodic surface being paired in essentially parallel planar relationship with an anode surface. The anode-cathode structure not only takes into account the structural weakness of refractory hard metal materials but also permits the changing of the RHM assembly during operation of the cell. Further, the anode-cathode structure enhances the removal of anode gas from the interpolar gap between the anode and cathode surfaces.

12 Claims, 10 Drawing Figures

ALUMINUM REDUCTION CELL ELECTRODE

BACKGROUND OF THE INVENTION

The Government of the United States of America has rights in this invention pursuant to Department of Energy Contract No. DE-AC03-76CS40215.

This invention relates to a novel and improved anode-cathode structure for electrolytic cells for the production of aluminum by the reduction of alumina and, more particularly, to the anode and cathode assemblies wherein the cathode assembly is comprised, at least on the surfaces thereof, of titanium diboride or other refractory hard metal materials or mixtures of these materials, such as the carbides and borides of the transition elements, titanium and zirconium (hereinafter collectively referred to as RHM) and an anode assembly comprising two anodes straddling a cathode assembly and wherein pairs of surfaces of the anode and the cathode assemblies are in juxtaposition and in substantially parallel arrangement and adapted to be oriented so as to have a high angle of slope with respect to a horizontal plane through the cell. Further, the invention relates to an RHM cathode assembly which can be readily replaced or changed during operation of the cell. Additionally, the invention relates to a system for the electrolytic production of aluminum utilizing the improved anode-cathode structure.

The electrolytic cell in general use today for the production of aluminum is of the classic Hall-Heroult design and utilizes carbon anodes and a carbon lined bottom which functions as part of the cathodic system. An electrolyte is used which consists primarily of molten cryolite with dissolved alumina and which may contain other materials such as fluorspar. Molten aluminum resulting from the reduction of the alumina accumulates at the bottom of the cell as a molten metal body over the carbon lined bottom and acts as a liquid metal cathode. The carbon anodes extend from above into the electrolyte, and the bottom faces of the anodes are maintained at a preselected distance from the surface of the molten metal. Current collector bars, usually of steel, are embedded in the carbon lined bottom and complete the connection to the cathodic system.

In the early 1950's RHM materials were first utilized for cathode constructions in aluminum reduction cells. Titanium and zirconium borides and carbide-boride mixtures were found suitable for these constructions, and various cathode constructions are shown in British Pat. Nos. 784,695; 784,696; 802,471 and 804,905 and in U.S. Pat. No. 3,028,324. This early RHM cathode development is chronicled in a published paper identified as follows: C. E. Ransley, "The Application of the Refractory Carbides and Borides to Aluminum Reduction Cells," *Extractive Metallurgy of Aluminum,* Volume 2, Interscience Publishers, New York (1963), page 487. RHM materials in pure form are very resistant to the molten aluminum and cryolite found in an aluminum reduction cell and, moreover, generally have higher electrical conductivities than the conventional carbon products used in a reduction cell. In addition, RHM materials, and in particular $TiB_2$, are readily wet by molten aluminum, whereas the carbon products normally used are not.

Although the early use of RHM materials in aluminum reduction cells was conceptually a significant improvement, such use was fraught with practical problems and, as a result, the development of RHM cathodes has not met with any significant commercial success.

One major problem faced by the investigators in this area was the deleterious effects of oxide in the RHM shapes used in the reduction cell. Normally, the RHM shapes were formed from RHM powder by either hot pressing or cold pressing and sintering. However, the surfaces of the RHM particles were oxidized to a certain extent so that when the powder was pressed into various shapes, a high concentration of oxide resulted at the interparticle or grain boundaries. The intergranular oxide could be readily attacked by molten aluminum so that the RHM particles or grains could be easily dislodged after molten aluminum attack at the grain boundaries, resulting in the rapid deterioration of the RHM cathode surface. During the early development work on RHM cathode materials, it was well known that the oxide content of RHM shapes must be kept as low as possible to avoid intergranular attack by molten aluminum. However, the art of RHM manufacture was not sufficiently advanced at that time to produce high purity RHM products which could withstand attack by molten aluminum for a significant period. Theoretically, RHM with no oxide content would be best, but it is not feasible to obtain such material in a commercial process. In recent times, several manufacturers have been able to produce $TiB_2$ shapes of a reasonable size with oxide contents less than 0.05% by weight, which makes the $TiB_2$ shapes very resistant to molten aluminum attack even at the grain boundaries where the oxide tends to be concentrated.

Because the RHM materials have a high elastic modulus and low Poisson's ratio, they are quite brittle and subject to thermal shock. As a general rule, RHM shapes should not be subjected to a temperature differential greater than 200° C. to avoid thermal cracking. They are more tolerant to heating up than cooling down conditions.

A particularly attractive aluminum reduction cell design utilizing RHM cathodic surfaces is shown in U.S. Pat. No. 3,400,061, to Lewis et al, wherein the RHM cathode surfaces comprised of a composite material of RHM and carbon are sloped on the order of 2° from the horizontal so that only a thin layer of molten aluminum which wets the RHM surface remains. The molten aluminum electrolytically formed during the operation of the cell drains from the sloped surface into the trough or trench located at the middle of the cell. The molten aluminum in the trough is not a part of the electrolytic circuit and can be removed as desired. Only the thin layer of molten aluminum which wets the RHM cathodic surface is involved in current transfer and permits electrolysis operation of a low interpolar or anode-cathode distance (ACD) which reduces the energy loss due to the resistance drop in the electrolyte.

A significant savings in energy (up to about 25%) would be realized by a low ACD, e.g., on the order of one-half inch, compared to the ACD, which is on the order of one and three quarters inches, required in the operation of a conventional reduction cell. Because of the cost of RHM material, it must be used in conjunction with other less expensive materials in cathode constructions, such as graphite and silicon carbide. In RHM cathode constructions, however, wherein the RHM material is supported on a carbonaceous substrate, there is a significant problem in that there is an extremely large difference in thermal expansion between RHM shapes and the supporting conductive carbonaceous substrate. The large difference in thermal expansion coefficients (e.g., about $2\times10^{-6}$ v. $8\times10^{-6}$ in/in °C.) precluded forming a bond which would be effective both during installation of the RHM shapes at room temperature and the operating temperature of the aluminum reduction cell. Any bond or rigid joint formed at room temperature when the RHM shapes are installed would be essentially destroyed by the thermal expansion during heatup to operating temperature.

The patents and technical literature are replete with references which describe attempts to solve the various problems in the use of $TiB_2$ and other RHM in the harsh environments of an aluminum reduction cell. Lewis et al in U.S. Pat. No. 3,400,061 and others utilized a mixture of $TiB_2$ and other refractory hard metals with small amounts of carbon to reduce the relatively large thermal expansion of the RHM materials. However, such composites did not have the service life necessary for commercial usage due to their susceptibility of attack by the electrolytic bath.

References such as U.S. Pat. Nos. 2,915,442; 3,081,254; 3,151,053; 3,161,579; and 3,257,307 describe RHM cathode bars in various positions. However, the RHM cathode bars, even though not functioning as the cathode per se but rather as a cathode lead from the molten aluminum cathode body, usually could not withstand the thermal distortion attendant with such designs and they inevitably fractured due to the brittleness of the RHM. In these structures, however, the RHM bars did not function as the cathode per se but rather as a current lead from the molten aluminum body which served as the cathode.

A recent development of RHM cathode design is that disclosed in U.S. Pat. No. 4,071,420, wherein an array of RHM parts or shapes, such as plates, bars, hollow cylinders and the like, are fastened or embedded at one extremity in the carbonaceous bottom of the cell, while the other extremity protrudes into the cryolitic bath and the parts are arranged preferably in a pattern of regularity beneath the anodic surface area of the carbon anode. However, these arrangements also have difficulties because of the brittleness of the RHM materials leading to a short life of the cathode members of the cell, necessitating premature shutdown of the cell for repairs. This causes a serious interruption of the productivity of the cell.

U.K. Published patent application No. 2,024,864 (Jan. 16, 1980) discloses a wettable cathode element which is exchangeable and which is made of titanium carbide, titanium diboride or pyrolitic graphite. Although this cathode element can be replaced during operation of the cell, the subelements of the RHM material are of complex shapes having sharp angles and corners and require the joining by screws and the like. A structure such as proposed would be subject to cracking under the rigors of an electrolytic cell environment.

It has long been recognized that the principal energy loss of the Hall-Heroult cell is due to the resistive loss of the electrolyte in the interpolar gap or anode-cathode distance (ACD). At typical current densities, this drop is about one volt per inch which is 20 to 25 percent of the total cell voltage. Much effort has been expended to minimize the ACD, but commercial conventional cells must operate in excess of one and one-half inches thereby requiring a voltage drop across the interpolar gap that is in excess of 30 percent of the total cell voltage. This requirement is due to the very strong inverse relationship between current efficiencies and ACD. Also, as the ACD is reduced toward one inch, the voltage becomes unstable. These effects are directly or indirectly the result of surface fluctuations of the molten aluminum body which, in the conventional cell, is the cell cathode. The metal motion is attributable to electromagnetic forces and hydrodynamic forces. The latter are created by the anode gases emerging from the interpolar gap.

The use of RHM, e.g., titanium diboride, cathodes is governed by the economic balance between the cost savings realized from reduced power consumption and the high material cost, coupled with the associated capital investment. The already large capital investment in existing aluminum reduction smelters favors the retrofitting of cells with $TiB_2$ cathodes rather than the replacement with a new cell design. Although the instant invention finds adaptation to existing cells, it can also be advantageously used in new construction.

The prior art attempts to use RHM materials as cathode material for aluminum reduction cells have all suffered from practical deficiencies that prevent their commercial use in Hall-Heroult cells, for example, the lack of achieving a long economic life, the catastrophic failure of the substrate when a localized RHM failure occurred, or the RHM cathode structure lacked dimensional stability, thereby the spatial relationship of ACD could not be preserved. Further, in the case of the RHM cathodes which have a horizontal or substantially horizontal orientation or even a moderate slope, there is experienced a difficulty in realizing a maximum voltage savings when operating at low ACD's because the anode gas bubbles generated during the reduction of alumina are not removed from the interpolar gap at a sufficient rate, thereby increasing the resistance across the interpolar gap. It has been found with low interpolar gaps, i.e., one-half inch or less, that the void or bubble-occupied fraction of the gap will be on the order of 50% or more of the volume of the gap which considerably increases the electrical resistance across the gap and reduces the energy savings calculated using a minimal void fraction. A steeply sloping relationship between the anode and RHM cathode surfaces would enhance the movement of the anode gases. An arrangement of this sort is shown in U.S. Pat. No. 3,028,324 to C. E. Ransley, FIGS. 2–5, inclusive, and in the aforementioned published paper by C. E. Ransley. Although the slope of the anode-cathode surfaces is not given, it is shown in the Figures as steeply sloped. Undoubtedly, the anode gases would be hastened in being expelled from the interpolar gap. However, the Ransley arrangement of anode and RHM cathode elements has certain disadvantages, such as, the RHM members are affixed to the cell lining and cannot be replaced by a "hot change" and the V-shaped carbon anode would not maintain its shape during operation and thereby it would be difficult to maintain the proper relationship between anode and cathode surfaces both as to the area and as to the ACD.

SUMMARY OF THE INVENTION

Accordingly, it is a primary purpose of this invention to provide a novel, improved anode-cathode structure for an electrolytic cell for the reduction of alumina, which structure is comprised of an RHM cathode assembly which is wedge shaped and has steeply sloped cathodic surfaces extending into the cell from a first apex and a carbon anode assembly comprised of two prebake carbon anodes depending into the cell from a second apex, above said first apex, and in an angular, straddling relationship with said cathodic surfaces, each anode having a surface paired in essentially parallel planar relationship with a sloped cathodic surface. This anode-cathode structure not only takes into account the structural weakness of RHM materials but also permits the changing of the RHM assembly without shutting down the cell. Further, the anode-cathode structure enhances the removal of anode gas from the interpolar gap between the paired anode and cathode surfaces.

BRIEF DESCRIPTION OF THE DRAWINGS

The invention will be further understood and the advantages thereof will become more apparent from the ensuing detailed description when taken in conjunction with the appended drawings which are schematic in character, with various details which are known to the art omitted for the sake of clarity of illustration.

DETAILED DESCRIPTION OF THE INVENTION

Figure 1:
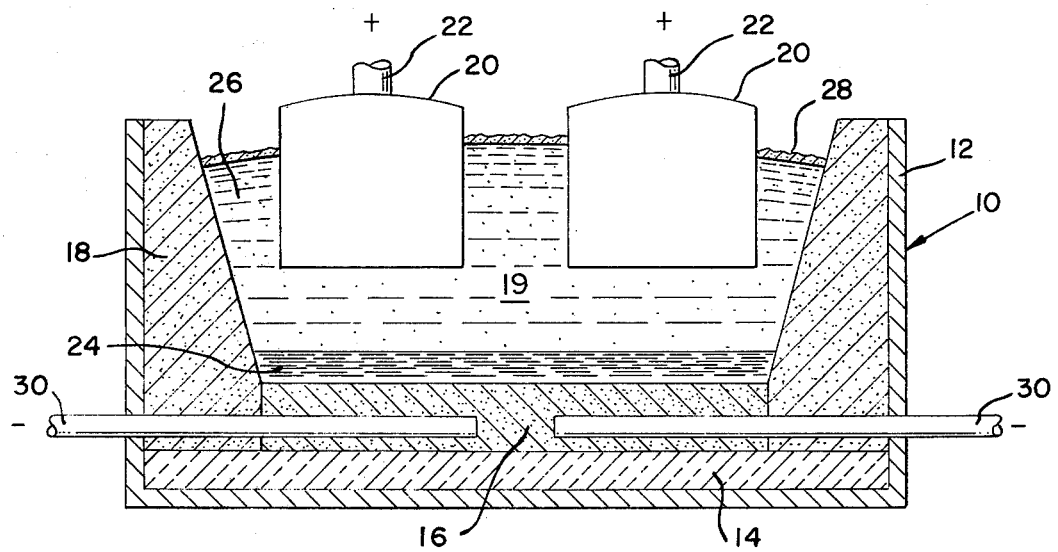
FIG. 1 is a transverse elevation view, partly in section, of a conventional electrolytic cell for the reduction of alumina using prebake anodes.

With reference to the drawings which are for the purpose of illustrating rather than limiting the invention and wherein the same reference numerals have been applied to corresponding parts, there is shown in FIG. 1 a transverse elevation view, partly in section, of a conventional aluminum reduction cell of the prebake type. The reduction cell 10 is comprised of a steel shell or vessel 12 having a layer 14 disposed in the bottom thereof of a suitable insulating material, such as alumina, and a carbonaceous bottom layer 16 in juxtaposition with insulating layer 14, said carbonaceous layer 16 being formed either by a monolithic layer of rammed carbon paste baked in place or by prebaked carbon blocks. The sidewalls 18 of cell 10 are generally formed of rammed carbon paste; however, other materials, such as silicon carbide bricks, can be used. The carbonaceous layer 16 and the sidewalls 18 define a cavity 19 adapted to contain a molten aluminum body or pad 24 and a molten body of electrolyte or bath 26 consisting essentially of cryolite having alumina dissolved therein. During operation, a crust 28 of frozen electrolyte and alumina is formed over the electrolyte layer 26. Alumina is fed to the cell by suitable means (not shown) per a selected schedule. Usually, the alumina is dumped onto the frozen crust layer 28, and periodically the frozen crust layer is broken by suitable means (not shown) to allow the heated alumina to flow into the bath 26 to replenish same. Steel collector bars 30 are embedded in carbonaceous bottom layer 16 and are electrically connected by suitable means at their extremities which protrude through the cell 10 to a cathode bus (not shown). The cell 10 is further comprised of a plurality of carbon anodes 20 supported within the electrolyte 26 by means of steel stubs 22 which are connected mechanically and electrically by suitable conventional means to an electric power source (not shown), such as by anode rods (not shown), which, in turn, are connected to an anode bus (not shown).

Figure 3:
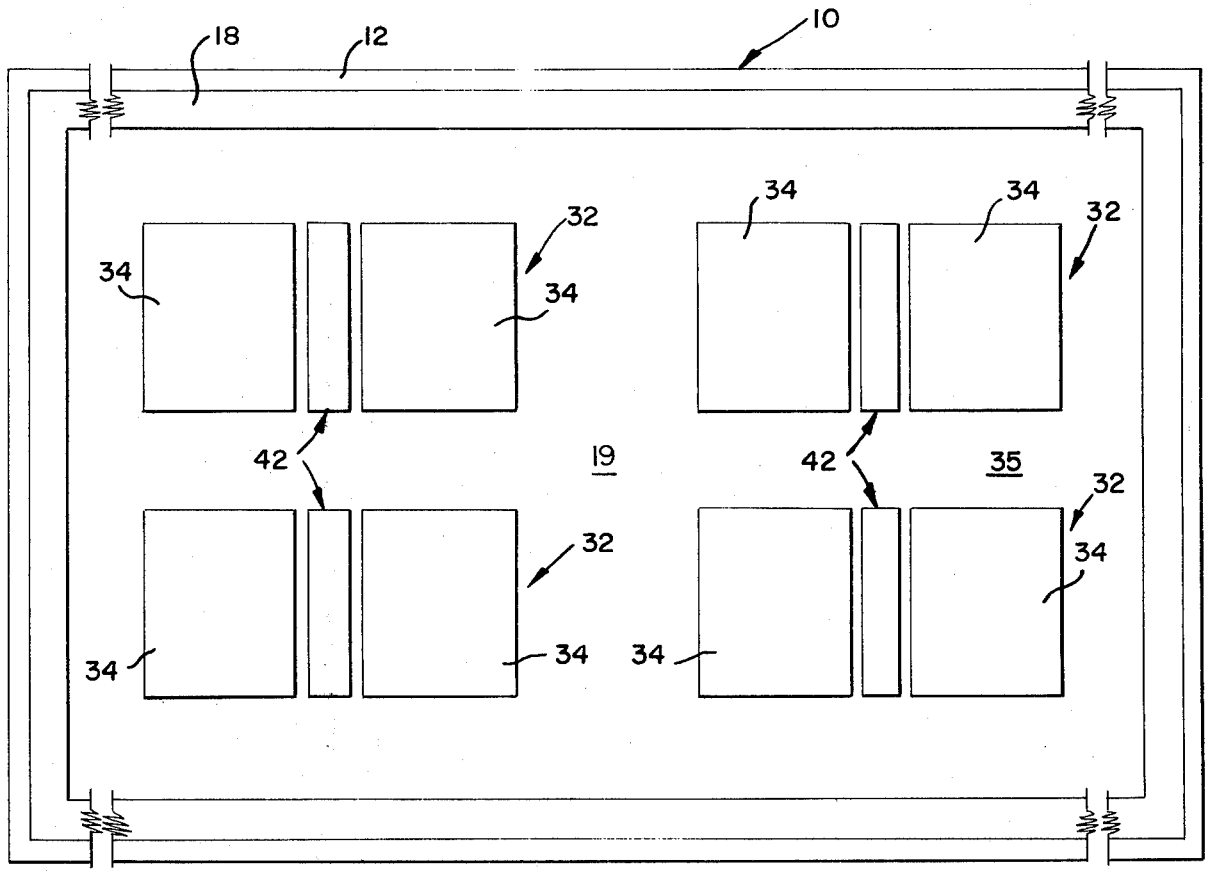
FIG. 3 is a plan view of the cell shown in FIG. 2 taken on the line 3—3 of FIG. 2 and shows the placement of the anode-cathode structures in the cell.
Figure 2:
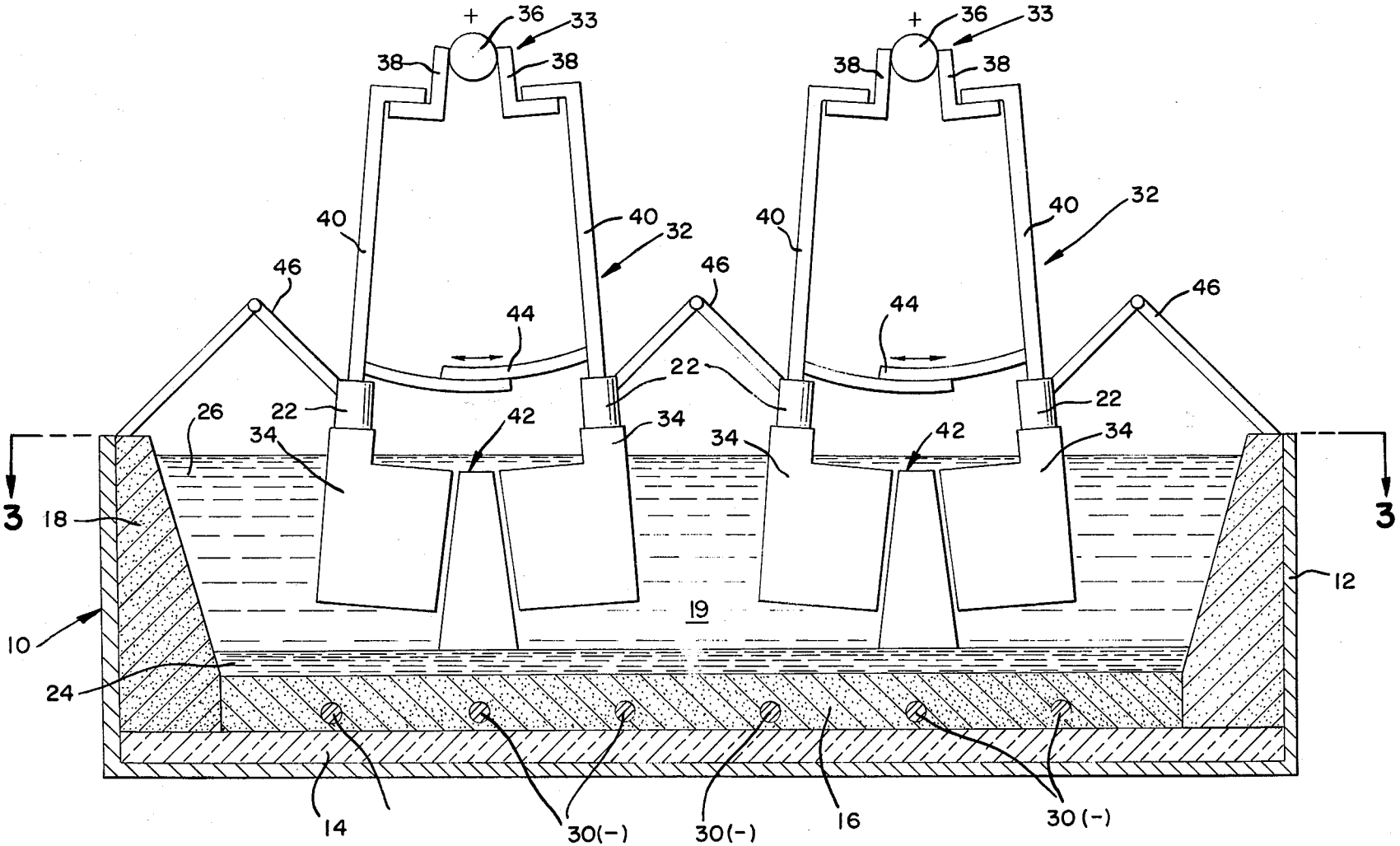
FIG. 2 is a longitudinal elevation view, partly in section, of an electrolytic cell, similar to that shown in FIG. 1, which has been retrofitted to accommodate one embodiment of the anode-cathode structure of the invention.

FIGS. 2 and 3 depict a cell 10, similar to that shown in FIG. 1, which has been retrofitted to accommodate one embodiment of the anode-cathode structure of the invention. A novel anode-cathode structure 32 is shown schematically and is comprised of a replaceable cathode assembly 42 which rests on the carbon bottom layer 16 and which is wedge shaped and has steeply sloped sides, e.g., at an angle of 60° to 85°, preferably 70° to 80°, from the horizontal. Each cathode assembly 42 is straddled by an anode assembly 33 which is comprised of two anodes 34 which are suspended from a suitable pivot mechanism 36 about which the anodes may be rotated for installing the cathode assembly 42 and for adjusting the ACD by any suitable means (not shown). The anodes are suspended from the pivot mechanism 36 by means of brackets 38, anode rods 40 suitably connected to brackets 38 and stubs 22. The brackets 38 and anode rods 40 are advantageously of aluminum metal, and a transition insert member (not shown) may be interposed between anode rods 40 and stubs 22, which are commonly of steel. A suitable transition insert material is discussed in regard to the cathode rod 70 of FIGS. 5, 6 and 7. The anodes are in electrical relationship to an anode bus member (not shown) by any suitable means, such as flexible connectors between the brackets 38 and the anode bus. The cell 10 is provided with insulated covers 44 and 46 in order to maintain the temperature of the cell and to prohibit a crust from forming on the surface of the bath 26. Covers 44 are curved insulated plates and may be suspended from the anode pivot mechanism 36 in order that the plates follow the motion of the anodes toward or away from the cathode assembly 42, as the case may be. Covers 46 are of the folding type and are located between anode-cathode structures and between an anode-cathode structure and an end of the cell.

Although only four anode-cathode structures are shown in the cell 10 of FIG. 3, it is understood that the cell is not so limited. A large electrolytic cell, on the order of 200,000 amperes, would be equipped with twelve or more anode-cathode structures. An anode-cathode structure may span essentially the width of the normal rectangular Hall cell cavity; however, it would be desirable that two such structures be paired side by side in the transverse direction, as shown in FIG. 3, in order to provide a center trench 35 to ensure proper circulation of the bath for feeding alumina into the cell.

Figure 4A:
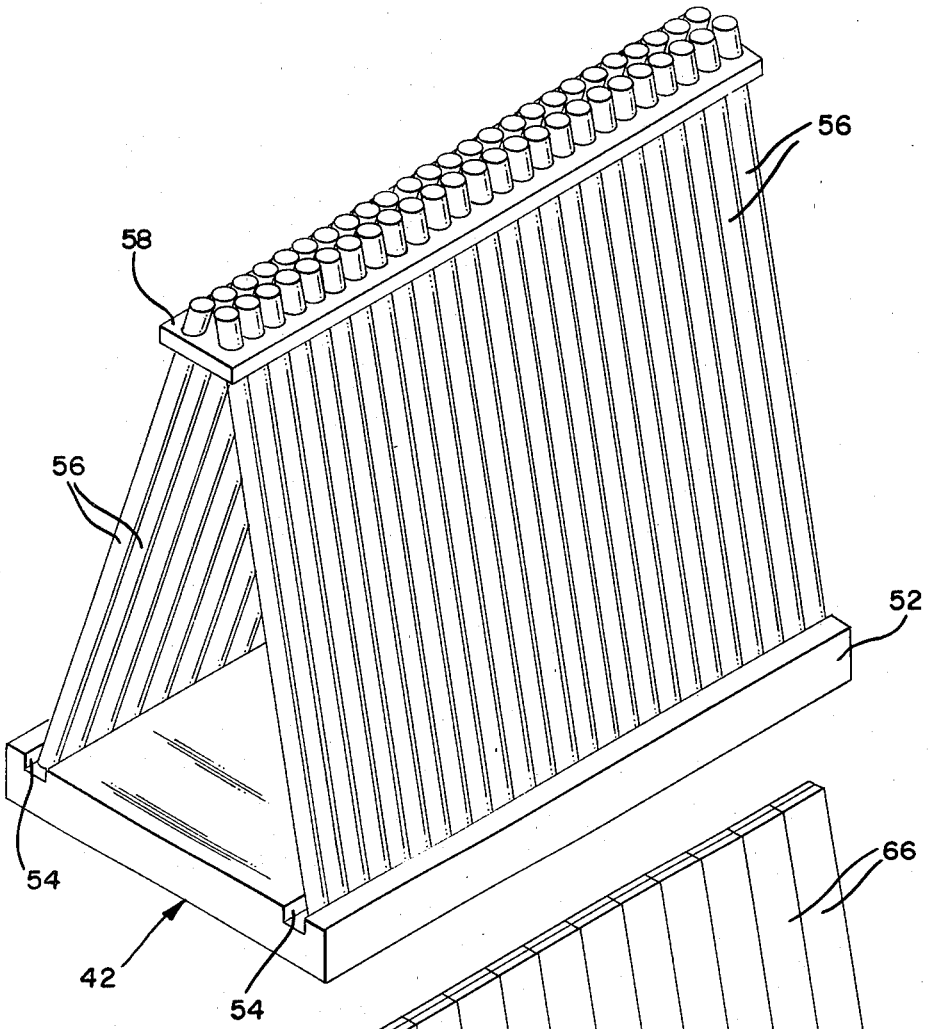
FIGS. 4A and 4B are perspective views of cathode assemblies for the cell of FIG. 2.
Figure 4B:
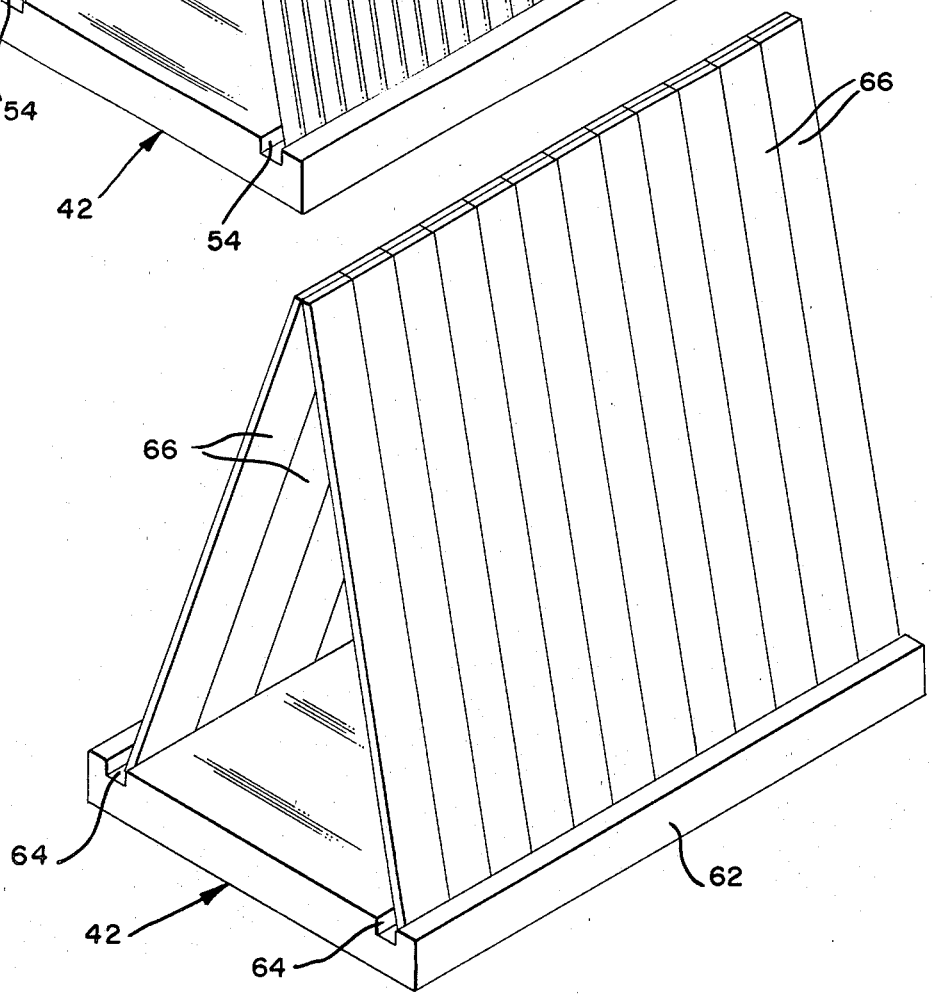

The cathode assembly 42, shown schematically in FIG. 2, may be of various designs, two of which are shown in FIGS. 4A and 4B. In FIG. 4A, the cathode assembly 42 is a module comprised of a rectangular base plate 52 of a suitable material, such as silicon carbide or other material resistant to molten aluminum and electrolyte. The base plate 52 has parallel channels 54 near the edges of the long sides of the base plate. One extremity of each $TiB_2$ bar 56 is positioned in channels 54 and cemented therein with a suitable material, such as an aluminum phosphate cement which incorporates silicon carbide grit. The other extremities of bars 56 are held by a plate 58, suitably of $TiB_2$, by appropriate openings in the plate. The dimension of a cathode module is governed by the size of the cell and the anode size. A typical module of the type shown in FIG. 4A may employ $TiB_2$ bar of the dimension of 1 inch diameter and $19\frac{1}{2}$ inches long. The module width, which is governed by the anode width, may vary from 27 inches to 34 inches.

FIG. 4B is a cathode module 42 having a base plate 62 of silicon carbide with parallel channels 64. Slats of $TiB_2$ material, which may be typically of the dimensions $\frac{1}{2}$ inch thick, 2 inches wide and $18\frac{3}{4}$ inches long, have extremities cemented in channels 56 as described for the module of FIG. 4A. As previously stated, the module width is governed by the anode width.

Various other cathode module designs than those shown in FIGS. 4A and 4B could be used. For example, the modules could be made of small pieces of $TiB_2$ material of rectangular cross section positioned horizontally and held in place by suitable means to a substrate inner core section, which has a triangular cross section and which is formed of a suitable material, such as silicon carbide. Or, $TiB_2$ pieces in rectangular block form could be stacked horizontally upon a base plate and held in place by dowels of RHM material joining contiguous blocks.

Figure 5:
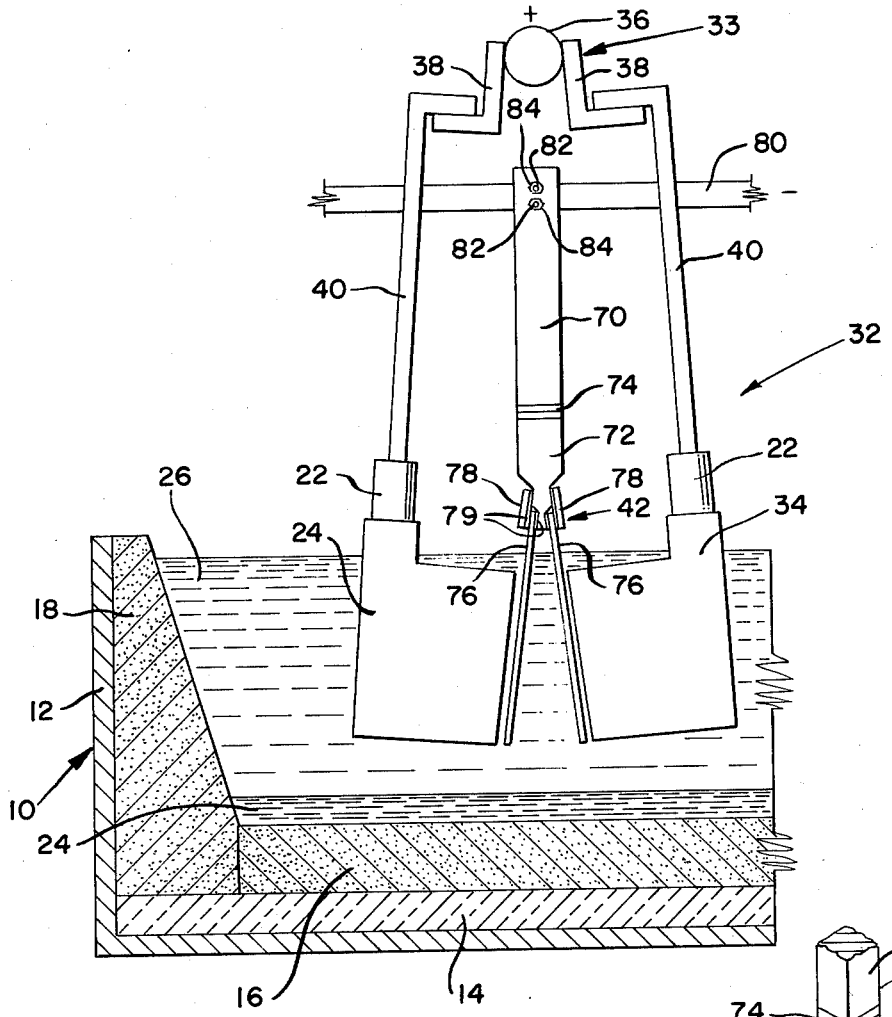
FIG. 5 is a partial, longitudinal elevation view, partly in section, of another embodiment of the anode-cathode structure of the invention.

FIG. 5 is a partial view, partly in section, of another embodiment of the invention wherein the anode-cathode structure 32 comprises a cathode assembly or module 42 which is top entering, that is, the wedge shaped module 42 is connected to a cathode bus 80 which is located above the cell 10. This eliminates the need for collector bars embedded in the carbon bottom as is the case with the usual electrolytic cell. Further, as the requirement for an electrically conductive bottom is eliminated, materials other than carbon can be used for the bottom and side linings. High alumina castable refractories, frozen bath material, silicon carbide and magnesium oxide refractories are examples of suitable refractories for the linings. The lining life would be considerably extended over that realized with conventional carbon linings. The intercalation of carbon by sodium, the impregnation of the carbon bottom by bath, or the infiltration by metallic aluminum of the carbon bottom causing short-circuiting from the collector bars to the molten aluminum body, all of which lead to premature deterioration of electrolytic cells, would be obviated by the embodiment shown in FIG. 5.

Although the cell in FIG. 5 depicts a retrofitted conventional cell with the usual carbon bottom 16 and carbon sidewalls 18, a noncarbon lining of the type discussed above would advantageously be installed upon the relining of the cell.

In the FIG. 5 embodiment, the cathode assembly 42 is comprised of $TiB_2$ members 76 which are steeply slanted from the horizontal and are clamped to a metal support or yoke member 72 by metal members 78. Support member 72 is joined by means of a transition insert member 74 to an aluminum cathode rod 70 which in turn is clamped to the cathode bus 80 by means of bolts 82 fastened to the bus 80 and secured thereto by nuts 84. The support members 72 and metal members 78 may be of any suitable metal, such as steel or aluminum bronze and the transition insert member 74 would be compatible to its mating members, that is, of the same or compatible material on one side as the support member 72 and aluminum on the side contiguous to the aluminum cathode rod 70. The transition insert material is advantageously made by roll bonding, as is well known in the art. The transition insert member 74 is joined by welding to the support member 72 and the cathode rod 70.

Figure 6:
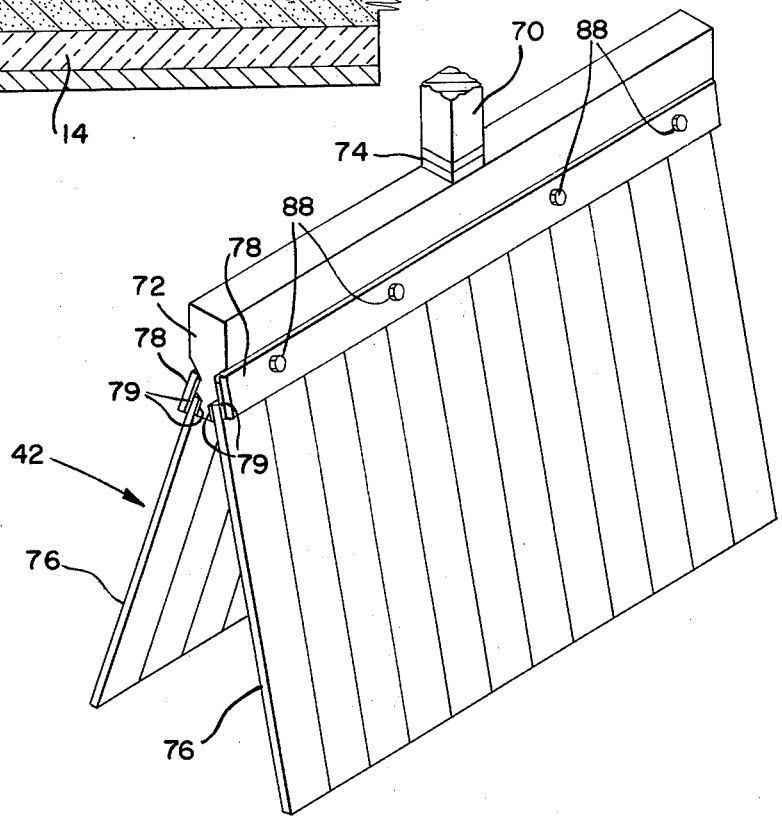
FIG. 6 is a perspective view of a top-entering cathode assembly which may be employed in the embodiment shown in FIG. 5.

FIG. 6 is a perspective view of the cathode assembly 42 of FIG. 5 showing in more detail how the $TiB_2$ members 76 are clamped to the support member 72. The $TiB_2$ members 76 are shown as having a rectangular cross section. However, other shapes such as round rods, square rods, etc., could be employed. In the case of round rods, the upper portion of the rods which is clamped to the support members 72 by means of metal members 78, should have flat surfaces produced either in the manufacture of the rod or by machining. The $TiB_2$ members are clamped in place by means of the metal members 78 being bolted to the support member 72 by bolts 88. In order that the $TiB_2$ members 76 are clamped in such a manner that there is good electrical contact between the $TiB_2$ members and the support member 72 without having an undue restraint placed on the end of the $TiB_2$ members, a layer 79 of a compliant metal is interleaved between the $TiB_2$ members 76, the support member 72 and the metal members 78. The compliant layer 79 may be shim material, nickel foil, a nickel plated layer which may be applied either by electroplating or electroless (chemical) plating. Alternatively, for the compliant layer, the ends of the $TiB_2$ members could be sprayed with an appropriate metal by plasma spraying or a metal coating could be applied by vapor deposition. The compliant metal layer should be on the order of five mils or greater thickness to protect the $TiB_2$ members from undue restraint when the clamping pressure is applied.

Figure 7:
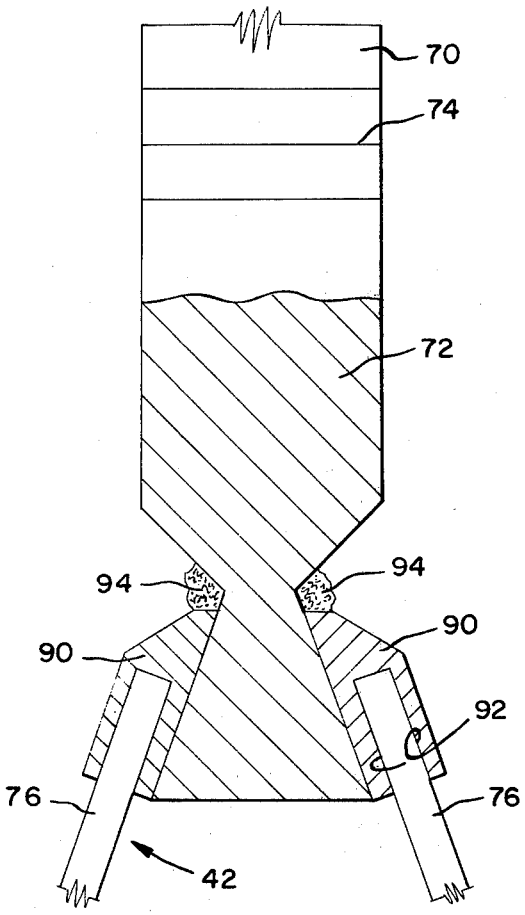
FIG. 7 is a partial, longitudinal elevation view of a further top-entering cathode assembly which may be employed in the embodiment shown in FIG. 5.

FIG. 7 is a partial view, in section, of a further embodiment of a cathode assembly 42 wherein the clamping means joining the $TiB_2$ members 76 to the support member 72 exerts a minimum of applied force while still maintaining the integrity of the electrical contact. In this embodiment, one extremity of a $TiB_2$ member 76 is coated by suitable metal caps 90, such as, aluminum bronze or a copper-nickel alloy, by casting the molten metal onto the extremity using a suitable mold. The $TiB_2$ surfaces may be prepared prior to the casting by plasma spraying, electroplating or vapor deposition of a thin layer of the metal onto the $TiB_2$ surfaces. This will ensure a good metallurgical bond between the $TiB_2$ members and the caps 90. The pieces may then be joined by welding the caps 90 to the support member 72 by welds 94. The welding method may either be by metal inert gas (MIG) or tungsten inert gas (TIG) welding methods.

In the operation of electrolytic cells employing the invention, it is advantageous to employ a low temperature electrolyte or bath, and to keep the bath from forming a top crust layer which would be detrimental to the cathode assembly and to the movement of the anodes. In order to prevent a top crust layer from forming, insulated covers on the cell would be required as is shown in the cell depicted in FIG. 2.

The bath or electrolyte composition should be of a low primary freezing point (e.g., a freezing point as low as 750° C.) in order that the cell can be operated at low temperatures (e.g., on the order of 770° C. to about 900° C.) as contrasted with the usual electrolytic cell temperature which is on the order of 970° C. Although the anode-cathode structure of the invention can be utilized in electrolytic cells operating at higher temperatures (e.g., up to 950° C.), the lower operating temperature promotes not only less deterioration of the RHM members but also less carbon consumption.

Examples of electrolytes or baths suitable for the anode-cathode structures of the invention are:

| | | |
|---|---|---|
| A. | $CaF_2$ | 3.1% by weight |
| | $MgF_2$ | 8.0% by weight |
| | LiF | 8.0% by weight |
| | NaF | 44.4% by weight |
| | $AlF_3$ | 32.9% by weight |
| | $Al_2O_3$ | 3.6% by weight |
| | Bath Ratio $\left(\frac{NaF}{AlF_3}\right)$ | – 1.35 |
| | Melting Point - 855° C. | |
| B. | An equimolar sodium cryolite-lithium cryolite composition, e.g., | |
| | $AlF_3$ | 45.2% by weight |
| | NaF | 33.9% by weight |
| | LiF | 20.9% by weight |
| | $Al_2O_3$ | 2–3% by weight |
| | Melting Point - 775° C. | |

The lithium compound addition is primarily responsible for the lowering of the melting point, thereby allowing for a lower operating temperature. Also, the lithium-containing electrolytes have a lower resistance than the normal cryolite electrolyte. However, the alumina solubility and solution rate at the lower temperatures possible with the lithium addition are decreased, requiring improved alumina feeding techniques, such as continuous or semi-continuous feeding.

The salient feature of the concept of the instant invention is the use of steeply sloped vertical cathode surfaces arranged in back-to-back pairs associated with anodes for the paired cathode surfaces which are suspended from an overhead structure and is located in the same vertical plane as the cathode structure. There are a number of essential advantages for this design, including the following:

1. The steeply sloped orientation of the interpolar gap will promote rapid upward motion of the two-phase mixture of bath and anode gases and thus minimize the void fraction. Also, the increased liquid bath flow through the gap will maintain a substantially uniform concentration of alumina throughout the interpolar space and essentially eliminate local anode effects.
2. More anode-cathode area can be provided in the same cell cavity as compared to a conventional cell.
3. Continuous or semi-continuous alumina feeding can be provided at the top of each cathode structure. The feed location provides an agitated surface of reduced alumina surface, reduced alumina concentration, and, if the alumina doesn't immediately dissolve, it can only fall through the interpolar gap against the stream velocity. Mucking of the pot would be minimized.

Figure 8:
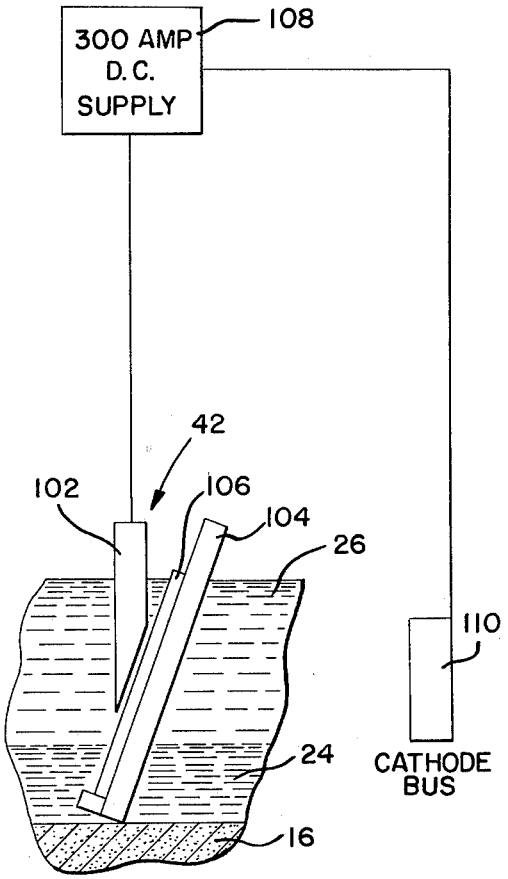
FIG. 8 is a diagrammatic sketch of a test assembly of the anode-cathode structure of the invention.

In order to demonstrate the effect of the steeply sloped anode/cathode structure of the invention in reducing the resistance across the interpolar gap, that is, the gap between the anode and cathode, in an operating cell, tests were conducted with an electrode assembly shown diagrammatically in FIG. 8. The test electrode assembly 42 shown therein is comprised of a graphite anode 102 and a planar array of parallel $TiB_2$ rods 106 which are supported by support member 104, advantageously constructed of silicon carbide. The anode 102 was connected to a 300 amp DC supply unit designated as 108 in FIG. 8 which in turn was connected to the cathode bus designated as 110. An anode was removed from a large (180 KA) conventional electrolytic cell, and the electrode assembly 42 was inserted into the cell in its stead so that the support member 104 of the test assembly 42 rested on the carbon cell bottom designated as 16. The $TiB_2$ rods 106 extended through the bath 26 and into the metal layer 24 thereby completing an electrical circuit with the carbon bottom having collector bars (not shown) installed therein which collector bars in turn would be electrically connected to the cathode bus 110.

The $TiB_2$ rods 106 had a diameter of 1 cm (0.4 in.) and 28 cm (11 in.) in length. The width of the array of $TiB_2$ rods 106 resting on the support member 104 was 18.5 cm (7.25 in.). The anode surface area opposing the $TiB_2$ rods was 184 $cm^2$ (28.5 square in.) and the ACD between the anode 102 and the array of $TiB_2$ bars 106 was 1.3 cm (0.5 in.).

With the test assembly 42 in place in the cell and operating under its separate DC power supply 108 and with the array of $TiB_2$ rods 106 inclined 75° with respect to the horizontal, voltage-current data were taken by measuring the voltage between the top of anode 102 and cathode $TiB_2$ rods 106 for various amperages. Several test runs were made, and the following data are representative of the tests.

| E (Volts) | I (AMPS) |
|---|---|
| 2.83 | 300 |
| 2.56 | 210 |
| 2.38 | 151.2 |
| 2.16 | 90 |
| 1.90 | 39 |

Figure 9:
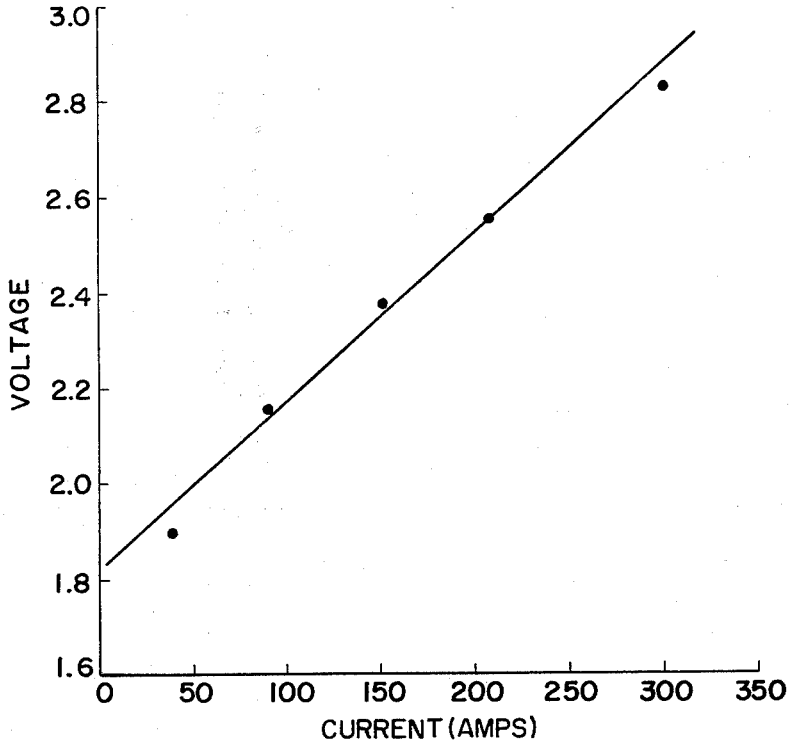
FIG. 9 is a volt-amperage (E-I) chart showing the data obtained in tests of the assembly shown in FIG. 8.

These data are plotted on the E-I chart of FIG. 9. When the linear portion of the plot is extrapolated to zero current, we find that the back EMF (counter EMF) is approximately 1.83 volts. The back EMF is comprised of the thermodynamically reversible decomposition potential in volts (which has a numerical value of 1.2 volts) plus the overvoltage which is the excess voltage above the reversible value which is required for the overall cell reaction to proceed at practical rates and current flow. The slope of the regression line of FIG. 9 is considered to be the interpolar resistance equivalent to that calculated by the one-dimensional conduction relationship.

$$R=(ACD/kA)$$

Where k is the conductivity of the electrolyte in Siemens and A is the electrode area in $cm^2$.

Assuming a conductivity of 2.15 Siemens, then:

$$R = \frac{1.3\text{cm}}{2.155 \times 1.84\text{cm}^2} = 3.3 \times 10^{-3}$$

The total interpolar voltage is expressed as:

$$E = \text{Back } EMF + R\,I$$
$$= 1.83 + 3.4 \times 10^{-3}\,I$$

The proper measure of energy savings versus ACD is the ratio of ideal ohmic resistance to the slope of the E-I plot (regression line) of FIG. 9. The following equations provide an expression of this criterion.

$$EI \text{ Plot Slope} = \frac{ACD}{k_{eff.} \times A} \quad (1)$$

$$\text{Ideal Ohmic Resistance} = \frac{ACD}{k \times A} \quad (2)$$

$$\text{Energy Savings Index } (C) = \frac{(2)}{(1)} = \frac{k_{eff.}}{k} \quad (3)$$

$$(C) = \frac{3.3 \times 10^{-3}\,\Omega}{3.4 \times 10^{-3}\,\Omega} = .97$$

The value for the Energy Savings Index obtained with the test assembly is higher than would be obtained with a larger anode-cathode assembly, that is, one which would be of a size used in a commercial operation. However, it should be expected that an Energy Savings Index of about 0.80 would be obtained. With an interpolar gap of low magnitude (on the order of 1.3 cm), it is estimated that the bubble or void fraction would be about 20% which is considerably less than that experienced with RHM cathodes oriented in a horizontal manner or in a substantially horizontal manner and with a low ACD. In other words, the effective conductivity would be about 80% of the ideal conductivity. Hence, the Energy Savings Index, C, would be about 0.80 which would entail a substantial savings in the power consumption in aluminum production.

In order to prevent thermal shock, the cathode assemblies are preheated in a suitable preheating furnace prior to installation in the electrolytic cell. The assembly should be heated to within approximately 50° C. of the cell bath temperature. In order to prevent thermal shock during the hot transfer, the module may be covered with a suitable insulating material, for example, refractory fibrous materials of aluminum silicate. These materials are readily available, and typical examples are Fiberfrax and Kaowool which are marketed under Registered Trademarks of Carborundum Co. and Babcock & Wilcox Co., respectively. The insulating material is placed over the assembly prior to placing in the preheating furnace and can be left on during transport and placing the assembly into the cell. The insulating material dissolves in the bath and does not affect the aluminum metal or operation of the cell. The cathode assembly can be placed in the preheating furnace, transported and placed into position in the cell by suitable tong mechanisms.

Advantageous embodiments of the invention have been shown and described, and it is obvious that various changes and modifications can be made therein without departing from the appended claims.

I claim:

1. In an electrolytic cell for the reduction of alumina having a cavity lined with refractory material and adapted to contain a molten aluminum body and a less dense body of molten electrolyte containing dissolved alumina, an anode-cathode structure comprised of at least one prebake anode depending into said cavity and a refractory hard metal cathode assembly positioned in said cavity and adapted to be in electrical relationship with said anode through the medium of said electrolyte, said anode-cathode structure having at least one planar anode surface with a high degree of slope measured from a horizontal plane through the cell and in juxtaposition with a substantially parallel planar surface of said cathode assembly, the improvement comprising at least one anode-cathode structure disposed within the cell, said structure having a wedge shaped replaceable cathode assembly having two cathode surfaces of refractory hard metal, each cathode surface having a high degree of slope and extending into the cell from a first apex and two prebake carbon anodes depending into the cell from a second apex, above said first apex, and in an angular, straddling relationship with said cathode surfaces, each anode having a surface adapted to be paired in essentially parallel planar relationship with a sloped cathode surface, means for spatially adjusting the distance between the paired anode and cathode surfaces, each of said cathode surfaces supported in operating position by clamping means located at least at one extremity thereof, said clamping means exerting a minimum of applied force on the cathode surface.

2. An anode-cathode structure according to claim 1 wherein each cathode surface is positioned at an angle from a horizontal plane through the cell in the range of 60° to 85°.

3. An anode-cathode structure according to claim 2 wherein each cathode surface is positioned at an angle from a horizontal plane through the cell in the range of 70° to 80°.

4. In an electrolytic cell for the reduction of alumina having a cavity lined with refractory material and adapted to contain a molten aluminum body and a less dense body of molten electrolyte containing dissolved alumina, an anode-cathode structure comprised of at least one prebake anode depending into said cavity and a refractory hard metal cathode assembly positioned in said cavity and adapted to be in electrical relationship with said anode through the medium of said electrolyte, said anode-cathode structure having at least one planar anode surface with a high degree of slope measured from a horizontal plane through the cell and in juxtaposition with a substantially parallel planar surface of said cathode assembly, the improvement comprising at least one anode-cathode structure disposed within the cell, said structure having a wedge shaped replaceable cathode assembly having back-to-back cathode surfaces of refractory hard metal, at least on the surfaces thereof, each cathode surface having a high degree of slope and depending into the cell cavity from a first apex and two prebake carbon anodes depending into the cell cavity from a second apex, above said first apex, and in an angular, straddling relationship with said cathode surfaces, each anode having a surface adapted to be paired in essentially parallel planar relationship with a sloped cathode surface, means for spatially adjusting the distance between the paired anode and cathode surfaces, said cathode assembly mechanically suspended from above the cell from a connection located above said first apex and below said second apex, said cathode surfaces consisting essentially of one or more refractory hard metal members, each of said members held by clamping and electrical contact means at least at one extremity, said clamping means exerting a minimum of applied force while still maintaining the integrity of the electrical contact.

5. An anode-cathode structure according to claim 4 wherein each cathode surface is positioned at an angle from a horizontal plane through the cell in the range of 60° to 85°.

6. An anode-cathode structure according to claim 5 wherein each cathode surface is positioned at an angle from a horizontal plane through the cell in the range of 70° to 80°.

7. An electrolytic system for the reduction of alumina wherein refractory hard metal is employed as a cathodic material, comprised of at least one anode-cathode structure disposed within a cavity formed by refractory lining within a vessel member, said refractory lined vessel provided with a molten electrolyte containing dissolved alumina and having a chemical composition and a melting point so that operation can be carried out in the range of about 770° C. to about 900° C., said anode-cathode structure having a wedge shaped replaceable cathode assembly having back-to-back cathode surfaces of refractory hard metal, at least on the surfaces thereof, each cathode surface of a high degree of slope depending into the cell cavity from a first apex and two prebake carbon anodes depending into the cell cavity from a second apex, above said first apex, and in an angular, straddling relationship with said cathode surfaces, each anode having a surface adapted to be paired in essentially parallel planar relationship with a sloped cathode surface, insulation means for covering the top of said vessel for retaining heat and preventing crust formation on the molten electrolyte surface, means for spatially adjusting the distance between the paired anode and cathode surfaces, said cathode surfaces consisting essentially of of one or more refractory hard metal members, means for supporting each cathode surface in operating position by clamping means at least at one extremity thereof, said clamping means exerting a minimum of applied force on the cathode surface.

8. The improvement of claim 7 wherein each cathode surface is positioned at an angle from a horizontal plane through the cell in the range of 60° to 85°.

9. The improvement of claim 8 wherein each cathode surface is positioned at an angle from a horizontal plane through the cell in the range of 70° to 80°.

10. An electrolytic system for the reduction of alumina, wherein refractory hard metal is employed as a cathodic material, comprised of at least one anode-cathode structure disposed within a cavity formed by refractory lining within a vessel member, said refractory lined vessel provided with a molten electrolyte containing dissolved alumina and having a chemical composition and a melting point so that operation can be carried out in the range of about 770° C. to about 900° C., said anode-cathode structure having a wedge shaped replaceable cathode assembly having back-to-back cathode surfaces of refractory hard metal, at least on the surfaces thereof, each cathode surface of a high degree of slope depending into the cell cavity from a first apex and two prebake carbon anodes depending into the cell cavity from a second apex, above said first apex, and in an angular, straddling relationship with said cathode surfaces, each anode having a surface adapted to be paired in essentially parallel planar relationship with a sloped cathode surface, insulation means for covering the top of said vessel for retaining heat and preventing crust formation on the molten electrolyte surface, means for spatially adjusting the distance between the paired anode and cathode surfaces, means for suspending said cathode from above the cell from a point located above said first apex and below said second apex, said cathode surfaces consisting essentially of one or more refractory hard metal members, means for clamping said refractory hard metal members at one extremity thereof for mechanical support and electrical contact, said clamping means exerting a minimum of applied force while still maintaining the integrity of the electrical contact.

11. An electrolytic system for the reduction of alumina according to claim 10 wherein each cathode surface is positioned at an angle from a horizontal plane through the cell in the range of 60° to 85°.

12. An electrolytic system for the reduction of alumina according to claim 11 wherein each cathode surface is positioned at an angle from a horizontal plane through the cell in the range of 70° to 80°.

* * * * *